US005918327A

United States Patent [19]

Vance

[11] Patent Number: 5,918,327

[45] Date of Patent: Jul. 6, 1999

[54] BATHTUB ENCLOSURE

[76] Inventor: Omar D. Vance, 1645 Louisville Rd., Seaman, Ohio 45679

[21] Appl. No.: 09/146,559

[22] Filed: Sep. 3, 1998

[51] Int. Cl.[6] ..... A47K 3/08

[52] U.S. Cl. ..... 4/557; 4/558; 4/608

[58] Field of Search ..... 4/557, 558, 559, 4/605, 607, 608, 609, 610; 160/133, 239, 238, 266

[56] References Cited

U.S. PATENT DOCUMENTS

| | | | |
|---|---|---|---|
| 4,915,152 | 4/1990 | Magee | 160/31 |
| 5,231,708 | 8/1993 | Hansen | 4/608 |
| 5,333,664 | 8/1994 | Sirianni et al. | 4/558 |
| 5,732,419 | 3/1998 | Feist | 4/558 |

*Primary Examiner*—David J. Walczak

[57] ABSTRACT

A bathtub enclosure for providing a leak proof enclosure for bathtubs. The enclosure includes an outer frame having a generally open rectangular configuration with spaced apart elongate top and bottom bars, and a pair of spaced apart elongate side bars extending between the top and bottom bars. The bars of the outer frame define a central space therebetween. The bottom bar is designed for attachment to the top of a side wall of a bathtub. The top bar is designed for attachment to a ceiling structure above the side wall of the bathtub. A first of the side bars is designed for attachment to a wall structure adjacent one end of the bathtub. A second of the side bars is designed for attachment to a wall structure adjacent another end of the bathtub. A pair of panels are provided in the central space of the outer frame. Each of the panels is extended between the top and bottom bars. One of the panels is positioned adjacent one of the side bars. Another of the panels is positioned adjacent another of the side bars. Each of the panels has an arcuate inner edges facing one another. The arcuate inner edges define therebetween a central opening sized for permitting a person to pass therethrough. The top bar has a blind assembly therein which has a retractably extendable flexible blind. The flexible blind is downwardly extendable from a retracted position in the top bar to a lowered position to substantially close the central opening between the panels.

9 Claims, 2 Drawing Sheets

BATHTUB ENCLOSURE

BACKGROUND OF THE INVENTION

1. Field of the Invention

The present invention relates to enclosures for bathtubs and showers and more particularly pertains to a new bathtub enclosure for providing a leak proof enclosure for bathtubs.

2. Description of the Prior Art

The use of enclosures for bathtubs and showers is known in the prior art. More specifically, enclosures for bathtubs and showers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,231,708; U.S. Pat. No. 5,033,132; U.S. Pat. No. Des. 334,682; U.S. Pat. No. 5,055,155; U.S. Pat. No. 4,916,764; and U.S. Pat. No. 4,765,001.

While these devices fulfill their respective, particular objectives and requirements, the aforementioned patents do not disclose a new bathtub enclosure. The inventive device includes an outer frame having a generally open rectangular configuration with spaced apart elongate top and bottom bars, and a pair of spaced apart elongate side bars extending between the top and bottom bars. The bars of the outer frame define a central space therebetween. The bottom bar is designed for attachment to the top of a side wall of a bathtub. The top bar is designed for attachment to a ceiling structure above the side wall of the bathtub. A first of the side bars is designed for attachment to a wall structure adjacent one end of the bathtub. A second of the side bars is designed for attachment to a wall structure adjacent another end of the bathtub. A pair of panels are provided in the central space of the outer frame. Each of the panels is extended between the top and bottom bars. One of the panels is positioned adjacent one of the side bars. Another of the panels is positioned adjacent another of the side bars. Each of the panels has an arcuate inner edges facing one another. The arcuate inner edges define therebetween a central opening sized for permitting a person to pass therethrough. The top bar has a blind assembly therein which has a retractably extendable flexible blind. The flexible blind is downwardly extendable from a retracted position in the top bar to a lowered position to substantially close the central opening between the panels.

In these respects, the bathtub enclosure according to the present invention substantially departs from the conventional concepts and designs of the prior art, and in so doing provides an apparatus primarily developed for the purpose of providing a leak proof enclosure for bathtubs.

SUMMARY OF THE INVENTION

In view of the foregoing disadvantages inherent in the known types of enclosures for bathtubs and showers now present in the prior art, the present invention provides a new bathtub enclosure construction wherein the same can be utilized for providing a leak proof enclosure for bathtubs.

The general purpose of the present invention, which will be described subsequently in greater detail, is to provide a new bathtub enclosure apparatus and method which has many of the advantages of the enclosures for bathtubs and showers mentioned heretofore and many novel features that result in a new bathtub enclosure which is not anticipated, rendered obvious, suggested, or even implied by any of the prior art enclosures for bathtubs and showers, either alone or in any combination thereof.

To attain this, the present invention generally comprises an outer frame having a generally open rectangular configuration with spaced apart elongate top and bottom bars, and a pair of spaced apart elongate side bars extending between the top and bottom bars. The bars of the outer frame define a central space therebetween. The bottom bar is designed for attachment to the top of a side wall of a bathtub. The top bar is designed for attachment to a ceiling structure above the side wall of the bathtub. A first of the side bars is designed for attachment to a wall structure adjacent one end of the bathtub. A second of the side bars is designed for attachment to a wall structure adjacent another end of the bathtub. A pair of panels are provided in the central space of the outer frame. Each of the panels is extended between the top and bottom bars. One of the panels is positioned adjacent one of the side bars. Another of the panels is positioned adjacent another of the side bars. Each of the panels has an arcuate inner edges facing one another. The arcuate inner edges define therebetween a central opening sized for permitting a person to pass therethrough. The top bar has a blind assembly therein which has a retractably extendable flexible blind. The flexible blind is downwardly extendable from a retracted position in the top bar to a lowered position to substantially close the central opening between the panels.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bathtub enclosure apparatus and method which has many of the advantages of the enclosures for bathtubs and showers mentioned heretofore and many novel features that result in a new bathtub enclosure which is not anticipated, rendered obvious, suggested, or even implied by any of the prior art enclosures for bathtubs and showers, either alone or in any combination thereof.

It is another object of the present invention to provide a new bathtub enclosure which may be easily and efficiently manufactured and marketed.

It is a further object of the present invention to provide a new bathtub enclosure which is of a durable and reliable construction.

An even further object of the present invention is to provide a new bathtub enclosure which is susceptible of a low cost of manufacture with regard to both materials and labor, and which accordingly is then susceptible of low prices of sale to the consuming public, thereby making such bathtub enclosure economically available to the buying public.

Still yet another object of the present invention is to provide a new bathtub enclosure which provides in the apparatuses and methods of the prior art some of the advantages thereof, while simultaneously overcoming some of the disadvantages normally associated therewith.

Still another object of the present invention is to provide a new bathtub enclosure for providing a leak proof enclosure for bathtubs.

Yet another object of the present invention is to provide a new bathtub enclosure which includes an outer frame having a generally open rectangular configuration with spaced apart elongate top and bottom bars, and a pair of spaced apart elongate side bars extending between the top and bottom bars. The bars of the outer frame define a central space therebetween. The bottom bar is designed for attachment to the top of a side wall of a bathtub. The top bar is designed for attachment to a ceiling structure above the side wall of the bathtub. A first of the side bars is designed for attachment to a wall structure adjacent one end of the bathtub. A second of the side bars is designed for attachment to a wall structure adjacent another end of the bathtub. A pair of panels are provided in the central space of the outer frame. Each of the panels is extended between the top and bottom bars. One of the panels is positioned adjacent one of the side bars. Another of the panels is positioned adjacent another of the side bars. Each of the panels has an arcuate inner edges facing one another. The arcuate inner edges define therebetween a central opening sized for permitting a person to pass therethrough. The top bar has a blind assembly therein which has a retractably extendable flexible blind. The flexible blind is downwardly extendable from a retracted position in the top bar to a lowered position to substantially close the central opening between the panels.

Still yet another object of the present invention is to provide a new bathtub enclosure that decreases the instances of water damage to floors and walls adjacent a bathtub or shower.

Even still another object of the present invention is to provide a new bathtub enclosure that quick and easy to install on a bathtub.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
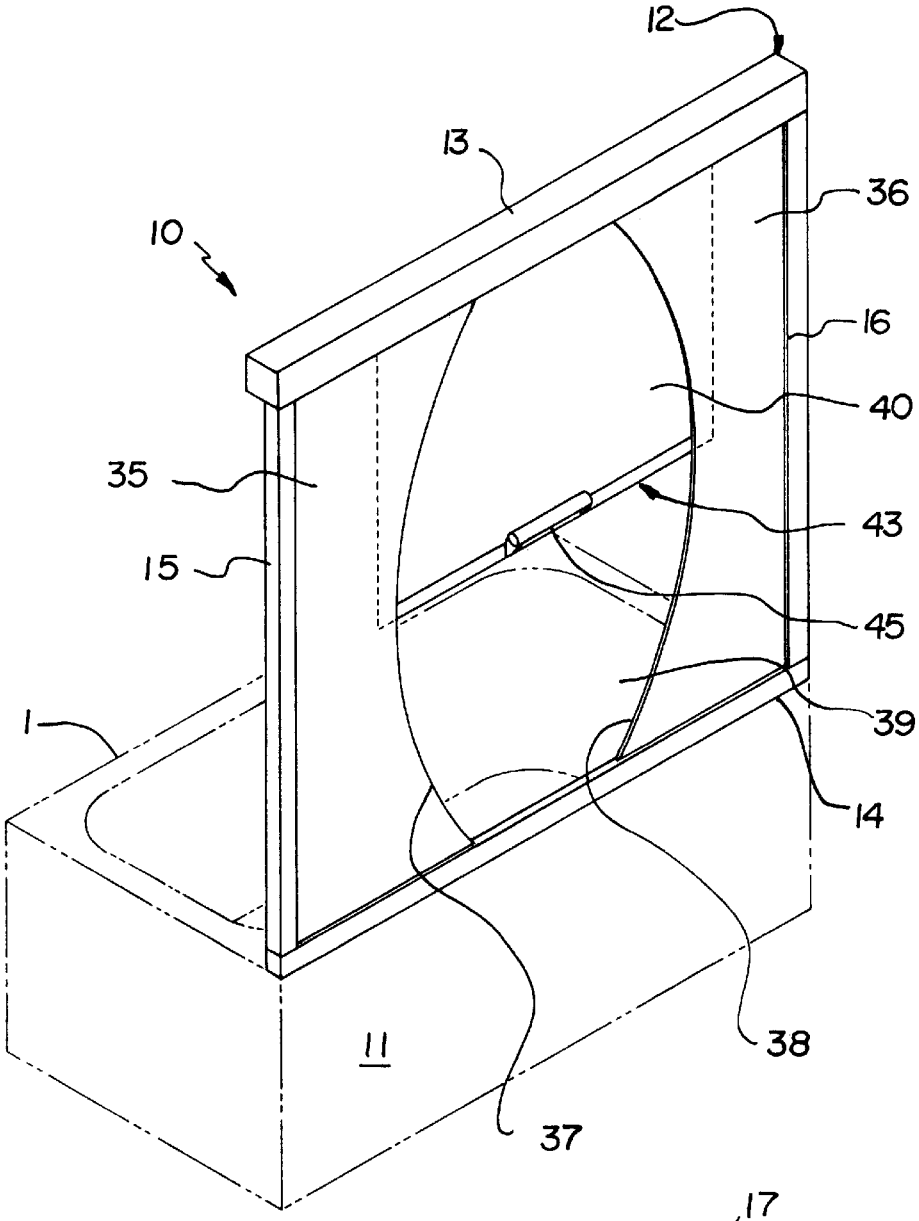
FIG. 1 is a schematic perspective view of a new bathtub enclosure on a bathtub according to the present invention.

With reference now to the drawings, and in particular to FIGS. 1 through 7 thereof, a new bathtub enclosure embodying the principles and concepts of the present invention and generally designated by the reference numeral 10 will be described.

As best illustrated in FIGS. 1 through 7 the bathtub enclosure 10 generally comprises an outer frame 12 having a generally open rectangular configuration with spaced apart elongate top and bottom bars 13,14, and a pair of spaced apart elongate side bars 15,16 extending between the top and bottom bars 13,14. The bars 13,14,15,16 of the outer frame 12 define a central space therebetween. The bottom bar 14 is designed for attachment to the top of a side wall of a bathtub 11. The top bar 13 is designed for attachment to a ceiling structure above the side wall of the bathtub 11. A first of the side bars 15 is designed for attachment to a wall structure adjacent one end of the bathtub 11. A second of the side bars 16 is designed for attachment to a wall structure adjacent another end of the bathtub 11. A pair of panels 35,36 are provided in the central space of the outer frame 12. Each of the panels 35,36 is extended between the top and bottom bars 13, 14. One of the panels 35 is positioned adjacent one of the side bars 15. Another of the panels 36 is positioned adjacent another of the side bars 16. Each of the panels 35,36 has an arcuate inner edge 37, 38 facing one another. The arcuate inner edges 37, 38 define therebetween a central opening 39 sized for permitting a person to pass therethrough. The top bar 13 has a blind assembly therein which has a retractably extendable flexible blind 40. The flexible blind 40 is downwardly extendable from a retracted position in the top bar 13 to a lowered position to substantially close the central opening 39 between the panels 35,36.

In closer detail, the enclosure 10 is comprises an outer frame 12 having a generally open rectangular configuration with spaced apart elongate top and bottom bars 13,14, and a pair of spaced apart elongate side bars 15,16 extending between the top and bottom bars 13,14. The bars 13,14,15, 16 of the outer frame 12 defining a central space therebetween. Each of the bars 13,14,15,16 has a pair of opposite ends. The top and bottom bars 13,14 are extended generally horizontally and the side bars 15,16 are extended generally vertically.

As illustrated in FIG. 1, the bottom bar 14 is designed for attachment to the top of a side wall of a bathtub 11 (or on the floor of a shower stall). The top bar 13 is designed for attachment to a ceiling structure above the side wall of the bathtub 11 (or shower stall). A first of the side bars 15 is designed for attachment to a wall structure adjacent one end of the bathtub 11 (or shower stall). A second of the side bars 16 is designed for attachment to a wall structure adjacent another end of the bathtub 11 (or shower stall).

Figure 3:
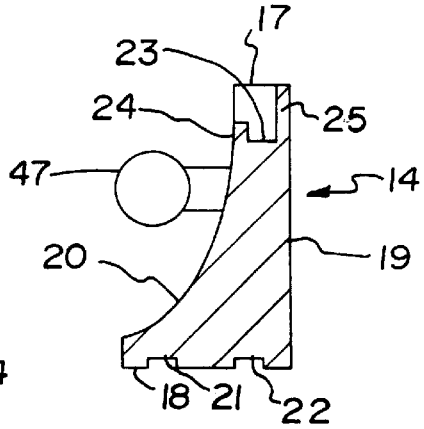
FIG. 3 is a schematic transverse cross sectional view of the bottom bar of the present invention taken from line 3—3 of FIG. 2.
Figure 2:
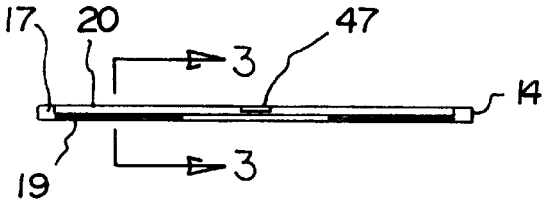
FIG. 2 is a schematic top view of the bottom bar of the present invention.

The bottom bar 14 has top, bottom, front, and back sides 17,18,19,20 extending between the ends of the bottom bar 14. The back side 20 of the bottom bar 14 is designed for positioning facing inwards towards the bathtub 11. The front side 19 of the bottom bar 14 is designed for positioning facing outwards from the bathtub 11. Preferably, the front side 19 of the bottom bar 14 is generally planar and lies in a generally vertical plane. As illustrated in FIG. 3, the back side 20 of the bottom bar 14 has an arcuate transverse cross section curving outwards adjacent the bottom side 18 of the bottom bar 14 so that the width of the bottom bar 14 tapers towards the top side 17 of the bottom bar 14. The back side 20 of the bottom bar 14 is curved to permit water flowing on the back side 20 of the bottom bar 14 to shed away from the bottom bar 14 and back into the bathtub 11. The bottom side 18 of the bottom bar 14 preferably has a pair of generally parallel elongate lower channels 21, 22 extending between the ends of the bottom bar 14. The lower channels 21, 22 of the bottom bar 14 are designed for receiving a sealant therein such as caulking for providing an substantially water-tight seal between the bottom side 18 of the bottom bar 14 and the top of the side wall of the bathtub 11.

The top side 17 of the bottom bar 14 has an elongate upper channel 23 extending between the ends of the bottom bar 14 with the front and back sides 19, 20 of the bottom bar 14 forming the spaced apart pair of side walls 24, 25 of the upper channel 23. The sides walls 24,25 of the upper channel 23 each have a height defined in a direction extending between the top and bottom sides 17,18 of the bottom bar 14. Preferably, the height of the side wall 24 of the upper channel 23 of the bottom bar 14 formed by the back side 20 of the bottom bar 14 is less than the height of the side wall 25 of the upper channel 23 of the bottom bar 14 formed by the front side 19 of the bottom bar 14 for letting water that falls into the upper channel 23 to drain back into the bathtub 11. Ideally, the height of the side wall 24 of the upper channel 23 of the bottom bar 14 formed by the back side 20 of the bottom bar 14 is less than one-half of the height of the side wall 25 of the upper channel 23 of the bottom bar 14 formed by the front side 19 of the bottom bar 14.

Figure 6:
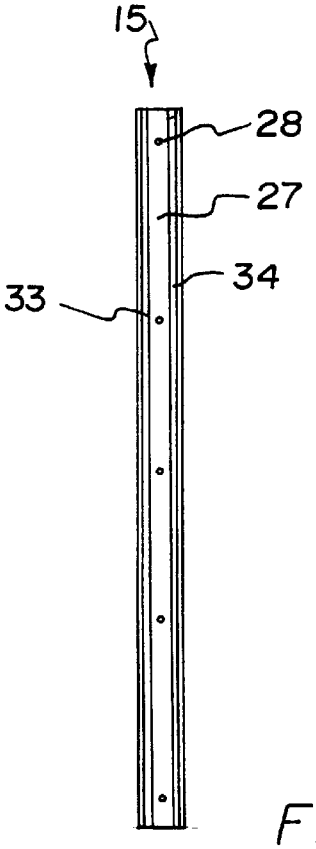
FIG. 6 is a schematic side view of the outer side of a side bar of the present invention.
Figure 7:
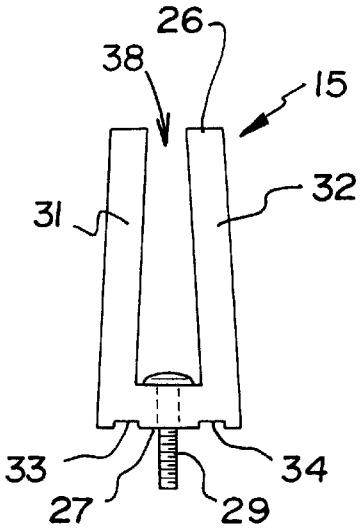
FIG. 7 is a schematic end view of one of the side bars of the present invention.

Each of the side bars 15, 16 has inner and outer sides 26,27. As illustrated in FIG. 6, the side bars 15,16 are secured to the wall structures preferably by threaded fasteners 29 extended through spaced apart holes 28 in the outer side 27 of respective side bar 15,16. With reference to FIG. 7, the inner side 26 of each of the side bars 15, 16 has an elongate side channel 38 extending between the ends of the respective side bar 15,16. The side channels 38 of the side bars 15,16 face inwards into the central space towards each other. Each of the side channels 38 of the side bars 15, 16 has a pair of side walls 31,32 converging towards one another in an inwards direction towards the inner side 26 of the respective side bar 15,16. Preferably, the outer sides 27 of the side bars 15,16 each preferably have a spaced apart pair of generally parallel elongate outer channels 33,34 extending between the ends of the respective side bar 15,16. The outer channels 33,34 are designed for receiving a sealant therein such as caulking for providing an substantially water-tight seal between the outer side 27 of the respective side bar 15,16 and the adjacent wall structure.

A pair of generally rigid panels 35,36 are provided in the central space of the outer frame 12. Each of the panels 35,36 is extended between the top and bottom bars 13,14 with one of the panels 35 positioned adjacent one of the side bars 15 and the other panel 36 positioned adjacent another of the side bars 16. The panels 35,36 each extend into the upper channel 23 of the bottom bar 14 and each of the panels 35,36 extends into the side channel 38 of the associated adjacent side bar 15,16. The tapering of the side walls 31,32 of the side channels help hold the panels in their respective side channel. Ideally, the panels 35,36 comprise a fiberglass material so that the panels 35,36 are resistant to water damage. Each of the panels 35,36 has an arcuate inner edge 37,38 facing one another. The arcuate inner edges 37,38 define therebetween a central opening 39 sized for permitting a person to pass therethrough the enclosure to provide access in and out of the bathtub 11. Each of the panels 35,36 has an inner face designed for facing into the bathtub 11 and an outer face designed for facing away from the bathtub 11.

The top bar 13 has a blind assembly therein similar in construction to a traditional retractable window shade assembly. The blind assembly has retractably extendable flexible blind 40 positioned adjacent the inner faces of the panels 35,36. The blind 40 is generally rectangular and has a lower edge 41 and ideally comprises a water impermeable flexible vinyl material. The flexible blind 40 is downwardly extendable from a retracted position in the top bar 13 to a lowered position to substantially close the central opening 39 between the panels 35,36 to prevent water from the bathtub 11 area to pass through the central opening 39. The lower edge 41 of the flexible blind 40 is inserted into the upper channel 23 of the bottom bar 14 when the flexible blind 40 is in the lowered position. The lower edge 41 of the flexible blind 40 is positioned adjacent the top bar 13 when the flexible blind 40 is in the retracted position.

Figure 4:
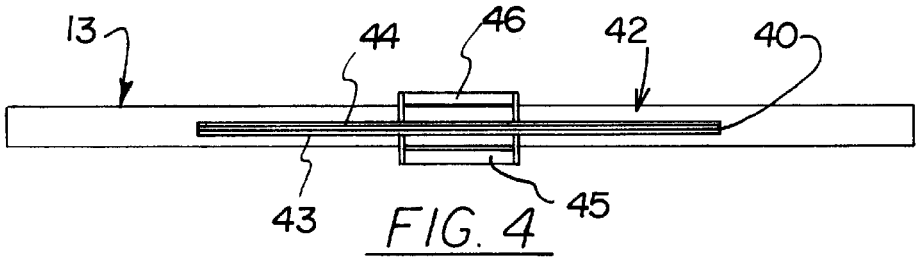
FIG. 4 is a schematic bottom view of the top bar of the present invention.
Figure 5:
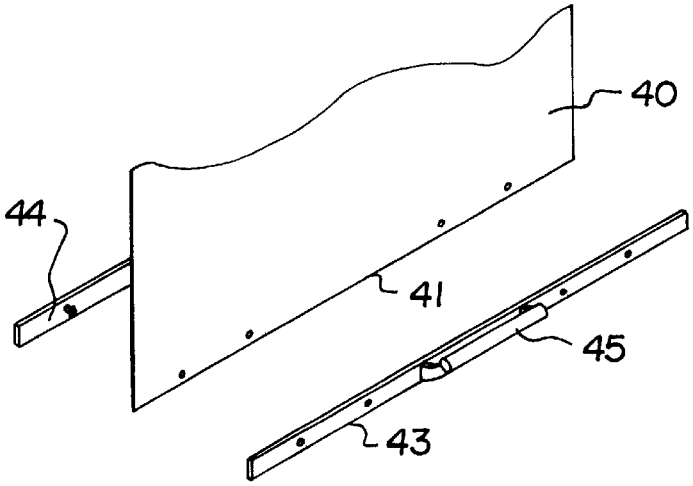
FIG. 5 is a schematic partial perspective view of the flexible blind of the present invention.

With reference to FIGS. 4 and 5, the flexible blind 40 has a handle assembly 42 coupled to the lower edge 41 of the flexible blind 40. The handle assembly 42 comprises a pair of elongate strips 43,44 each having a handle 45,46 coupled thereto so that the lower edge 41 of the flexible blind 40 is sandwiched between the elongate strips 43,44 of the handle assembly 42. The handles 45,46 of the handle assembly 42 extending in opposite outwards directions from the flexible blind 40. The back side 20 of the bottom bar 14 has a generally cylindrical rod 47 coupled thereto. In use, the rod 47 is designed for hanging items thereon such as washcloths and also for securing the inner handle 46 of the handle assembly 42 to help keep the blind assembly in the lowered position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An enclosure for a bathtub, comprising:

an outer frame having a generally open rectangular configuration and having spaced apart elongate top and bottom bars, and a pair of spaced apart elongate side bars extending between said top and bottom bars, said bars of said outer frame defining a central space therebetween, each of said bars having a pair of opposite ends;

said bottom bar being adapted for attachment to the top of a side wall of a bathtub, said top bar being adapted for attachment to a ceiling structure above the side wall of the bathtub, a first of said side bars being adapted for attachment to a wall structure adjacent one end of the bathtub, a second of said side bars being adapted for attachment to a wall structure adjacent another end of the bathtub;

a pair of panels being provided in said central space of said outer frame, each of said panels being extended between said top and bottom bars, one of said panels being positioned adjacent one of said side bars, another of said panels being positioned adjacent another of said side bars;

each of said panels having an arcuate inner edge facing one another, said arcuate inner edges defining a central opening sized for permitting a person to pass therethrough;

said top bar having a blind assembly therein, said blind assembly having a retractably extendable flexible blind; and said flexible blind being downwardly extendable from a retracted position in said top bar to a lowered position to substantially close said central opening between said panels.

2. The enclosure of claim 1, wherein said bottom bar has top, bottom, front, and back sides extending between the ends of said bottom bar, said back side of said bottom bar being adapted for positioning facing inwards towards the bathtub, said front side of said bottom bar being adapted for positioning facing outwards from the bathtub, said front side of said bottom bar being generally planar and lying in a generally vertical plane, said back side of said bottom bar having an arcuate transverse cross section curving outwards adjacent said bottom side of said bottom bar.

3. The enclosure of claim 2, wherein said bottom side of said bottom bar has a pair of generally parallel elongate lower channels extending between the ends of said bottom bar, said lower channels of said bottom bar being adapted for receiving a sealant therein for providing an substantially water-tight seal between said bottom side of said bottom bar and the top of the side wall of the bathtub.

4. The enclosure of claim 2, wherein said top side of said bottom bar has an elongate upper channel extending between the ends of said bottom bar, said front and back sides of said bottom bar forming a spaced apart pair of side walls of said upper channel of said bottom bar.

5. The enclosure of claim 4, wherein said sides walls of said upper channel of said bottom bar each have a height defined in a direction extending between said top and bottom sides of said bottom bar, said height of said side wall of said upper channel of said bottom bar formed by said back side of said bottom bar being less than said height of said side wall of said upper channel of said bottom bar formed by said front side of said bottom bar.

6. The enclosure of claim 5, wherein said height of said side wall of said upper channel of said bottom bar formed by said back side of said bottom bar being less than one-half of said height of said side wall of said upper channel of said bottom bar formed by said front side of said bottom bar.

7. The enclosure of claim 1, wherein each of said side bars has inner and outer sides, said inner side of each of said side bars having an elongate side channel extending between the ends of the respective side bar, said side channels of said side bars facing inwards towards each other, each of said side channels of said side bars having a pair of side walls converging towards one another in an inwards direction towards said inner side of the respective side bar.

8. The enclosure of claim 1, wherein said blind is generally rectangular and has a lower edge, and wherein said flexible blind has a handle assembly coupled to said lower edge of said flexible blind, said handle assembly comprising a pair of elongate strips each having a handle coupled thereto, said lower edge of said flexible blind being positioned between said elongate strips of said handle assembly, said handles of said handle assembly extending in opposite outwards directions from said flexible blind.

9. An enclosure for a bathtub, comprising:

an outer frame having a generally open rectangular configuration and having spaced apart elongate top and bottom bars, and a pair of spaced apart elongate side bars extending between said top and bottom bars, said bars of said outer frame defining a central space therebetween;

each of said bars having a pair of opposite ends, said top and bottom bars being extended generally horizontally, said side bars being extended generally vertically;

said bottom bar being adapted for attachment to the top of a side wall of a bathtub, said top bar being adapted for attachment to a ceiling structure above the side wall of the bathtub, a first of said side bars being adapted for attachment to a wall structure adjacent one end of the bathtub, a second of said side bars being adapted for attachment to a wall structure adjacent another end of the bathtub;

said bottom bar having top, bottom, front, and back sides extending between the ends of said bottom bar, said back side of said bottom bar being adapted for positioning facing inwards towards the bathtub, said front side of said bottom bar being adapted for positioning facing outwards from the bathtub;

said front side of said bottom bar being generally planar and lying in a generally vertical plane;

said back side of said bottom bar having an arcuate transverse cross section curving outwards adjacent said bottom side of said bottom bar;

said bottom side of said bottom bar having a pair of generally parallel elongate lower channels extending between the ends of said bottom bar, said lower channels of said bottom bar being adapted for receiving a sealant therein for providing an substantially water-tight seal between said bottom side of said bottom bar and the top of the side wall of the bathtub;

said top side of said bottom bar having an elongate upper channel extending between the ends of said bottom bar, said front and back sides of said bottom bar forming a spaced apart pair of side walls of said upper channel of said bottom bar;

said sides walls of said upper channel of said bottom bar each having a height defined in a direction extending between said top and bottom sides of said bottom bar, said height of said side wall of said upper channel of said bottom bar formed by said back side of said bottom bar being less than said height of said side wall of said upper channel of said bottom bar formed by said front side of said bottom bar;

wherein said height of said side wall of said upper channel of said bottom bar formed by said back side of said bottom bar being less than one-half of said height of said side wall of said upper channel of said bottom bar formed by said front side of said bottom bar;

each of said side bars having inner and outer sides;

said inner side of each of said side bars having an elongate side channel extending between the ends of the respective side bar, said side channels of said side bars facing inwards towards each other;

each of said side channels of said side bars having a pair of side walls converging towards one another in an inwards direction towards said inner side of the respective side bar;

said outer sides of said side bars each having a spaced apart pair of generally parallel elongate outer channels extending between the ends of the respective side bar, said outer channels being adapted for receiving a sealant therein for providing an substantially water-tight seal between said outer side of the respective side bar and the adjacent wall structure;

a pair of panels being provided in said central space of said outer frame, each of said panels being extended between said top and bottom bars, one of said panels being positioned adjacent one of said side bars, another of said panels being positioned adjacent another of said side bars;

said panels extending into said upper channel of said bottom bar, each of said panels being extended into the side channel of the associated adjacent side bar;

each of said panels having an arcuate inner edge facing one another, said arcuate inner edges defining a central opening sized for permitting a person to pass therethrough;

each of said panels having an inner face adapted for facing into the bathtub and an outer face adapted for facing away from the bathtub;

said top bar having a blind assembly therein, said blind assembly having a retractably extendable flexible blind, said blind being generally rectangular and having a lower edge;

said flexible blind being positioned adjacent said inner faces of said panels; said flexible blind being downwardly extendable from a retracted position in said top bar to a lowered position to substantially close said central opening between said panels, said lower edge of said flexible blind being inserted into said upper channel of said bottom bar when said flexible blind is in said lowered position, said lower edge of said flexible blind being positioned adjacent said top bar when said flexible blind is in said retracted position; and said flexible blind having a handle assembly coupled to said lower edge of said flexible blind, said handle assembly comprising a pair of elongate strips each having a handle coupled thereto, said lower edge of said flexible blind being positioned between said elongate strips of said handle assembly, said handles of said handle assembly extending in opposite outwards directions from said flexible blind.

* * * * *